US005720906A

United States Patent [19]

Yamanaka et al.

[11] Patent Number: 5,720,906

[45] Date of Patent: Feb. 24, 1998

[54] DOWN-DRAFTING CONSTANT VACUUM TYPE DIAPHRAGM CARBURETTOR

[76] Inventors: Susumu Yamanaka, 3189-4. Tokiwa-cho, Machida-shi, Tokyo; Katsuhiko Tsutsui, 1305-4. Nakano Tsukui-cho, Tsukui-gun, Kanagawa-ken; Masaru Asada; Shigemitsu Nitta, both of 1-1 Kawasaki-cho, Akashi, 673, all of Japan

[21] Appl. No.: 677,300

[22] Filed: Jul. 9, 1996

[30] Foreign Application Priority Data

Feb. 1, 1996 [JP] Japan ..... 8-038934

[51] Int. Cl.[6] ..... F02M 17/04

[52] U.S. Cl. ..... 261/35; 261/DIG. 68; 261/44.4

[58] Field of Search ..... 261/44.4, DIG. 68, 261/35

[56] References Cited

U.S. PATENT DOCUMENTS

| | | | |
|---|---|---|---|
| 1,897,742 | 2/1933 | Viel | 261/DIG. 68 |
| 1,933,379 | 10/1933 | Mock | 261/DIG. 68 |
| 2,144,017 | 1/1939 | Gistucci | 261/DIG. 68 |
| 4,290,399 | 9/1981 | Takada et al. | 261/44.4 |

FOREIGN PATENT DOCUMENTS

| | | | |
|---|---|---|---|
| 0088455 | 5/1983 | Japan | 261/DIG. 68 |
| 0225755 | 10/1987 | Japan | 261/44.4 |

*Primary Examiner*—Tim R. Miles

*Attorney, Agent, or Firm*—Cushman Darby & Cushman IP Group of Pillsbury Madison & Sutro LLP

[57] ABSTRACT

A down-drafting constant vacuum pressure type diaphragm carburettor includes a carburettor body with an induction passage, a throttle valve, a Venturi portion variable of open area. A vacuum actuated valve is arranged at upstream side of the throttle valve across the induction passage and extending in horizontal direction from one side to the other side, and controls an open area of a Venturi portion depending upon a vacuum pressure generated in the Venturi portion. A jet needle is mounted on the vacuum actuated valve. A fuel control system including a diaphragm arranged between a recessed portion of the carburettor body and a cover covering for defining a regulator chamber at the side of the recessed portion and an atmospheric pressure chamber at the side of the cover, and a valve seat. The diaphragm is arranged at lower side of a longitudinal axis of the jet needle.

2 Claims, 3 Drawing Sheets

DOWN-DRAFTING CONSTANT VACUUM TYPE DIAPHRAGM CARBURETTOR

BACKGROUND OF THE INVENTION

1. Field of the Invention

The present invention relates to a carburettor for an internal combustion engine, for adjusting and controlling amount and concentration of an air/fuel mixture.

2. Description of the Related Art

First prior art is disclosed in Japanese Examined Utility Model Publication (Kokoku) No. Heisei 4-37248. In the above-identified publication, the following technology has been disclosed.

In a carburettor body, an induction passage is formed in vertical direction therethrough. In the induction passage, a vacuum actuation valve for variably controlling area of a Venturi portion depending upon a vacuum generated in the Venturi portion, is movably arranged across the induction passage in horizontal direction. A jet needle mounted on the vacuum actuation valve and having a longitudinal axis extending in horizontal direction, extends horizontally from a bottom of the vacuum actuation valve toward the other side across the Venturi portion. The jet needle is inserted into a needle jet opening horizontally toward the Venturi portion. On the other hand, as a fuel control system, a valve seat is arranged at an end portion of a fuel passage. A control hole of the valve seat is opened and closed by a float valve operating by movement of a float arranged within a float chamber to form a float type fuel control system. By this, within the float chamber, a constant liquid surface parallel to the longitudinal axis of the jet needle mounted on the vacuum actuation valve and extending horizontally.

Second prior art is disclosed in Japanese Examined Utility Model Publication No. (Showa)47-26742. In the publication, an induction passage extending in horizontal direction is formed through the carburettor body. In the induction passage, a slide valve mechanically operated by a driver and functioning as variable Venturi in vertical direction, is arranged movably. A jet needle mounted on the slide valve extends downwardly from a bottom portion of the slide valve and is inserted into a needle jet opening to the induction passage opposing to the bottom of the slide valve. On the other hand, a fuel control valve having following construction is employed. A diaphragm is arranged in horizontal direction perpendicularly detecting across the longitudinal direction of the jet needle. The diaphragm is formed into an annular configuration by sandwiching the central annular portion and outer circumferential annular portion of the diaphragm with the carburettor body and a cover, and is arranged in opposition to the outer periphery of the jet needle. An annular regulator chamber is defined by an upper surface of the diaphragm and a lower recessed portion of the carburettor body to form an annular atmospheric chamber formed with the lower surface of the diaphragm and the cover. Then, in the regulator chamber, the valve seat is arranged to open to the end of the fuel passage. A control hole of the valve seat is opened and closed by a valve operated by movement of the diaphragm. Thus, by displacement of the diaphragm moving depending upon vacuum applied to the diaphragm, a desired amount of fuel can be introduced into the regulator chamber. Such duel control system is called as diaphragm type fuel control system.

Third prior art has been disclosed in Japanese Unexamined Utility Model Publication No. Showa 62-76276. In this publication, an induction passage is formed vertically through a carburettor body. In the induction passage, a butterfly type throttle valve is arranged rotatably. As a fuel supply system, a diaphragm type fuel supply system is employed in the disclosed carburettor. The diaphragm is located at one side of the carburettor body and arranged in vertical direction along the induction passage. A regulator chamber detecting in vertical direction is defined by the right side surface of the diaphragm and a left side recessed portion of the carburettor body. On the other hand, an atmospheric pressure chamber extending in the vertical direction is defined by the left side surface of the diaphragm and a cover covering the former. A valve seat is disposed within the regulator chamber at the end of a fuel passage with opening thereto. A control hole of the valve seat is opened and closed by a valve operated by movement of the diaphragm. Thus, desired amount of fuel can be introduced into the regulator chamber by displacement of the diaphragm depending upon a vacuum exerted on the diaphragm. Furthermore, a main fuel jet is opened toward the Venturi portion from the regulator chamber, and a low velocity fuel jet opened toward the induction passage at the downstream side from the regulator chamber.

By the first prior art, the open area of the Venturi portion is controlled by the vacuum actuation valve actuated depending upon the vacuum generated in the Venturi portion. Therefore, flow velocity of the air flowing through the Venturi portion can be maintained substantially constant for improving atomization characteristics of the fuel flowing through the induction passage. However, during operation of the engine, it is not desirable to install such carburettor for the engine, in which the carburettor is tilted significantly or is reversed. The reason is that, in the fuel control system constituted of the float, valve seat and valve, significant tilting or reversing should disable pivotal motion of the float which is pivotably mounted on a shaft to make fuel level control function for maintaining the fuel level constant inoperative.

On the other hand, by the second prior art, by employing the diaphragm type fuel control system for controlling fuel supply amount, it becomes possible to arrange the induction passage in vertical direction to form a down-draft type carburettor, in which air flows from upper side to lower side within the induction passage to achieve improvement in engine start-up characteristics and acceleration characteristics. However, on the other hand, the second prior art encounters the following drawbacks. Since the diaphragm is arranged in an orientation perpendicular to the longitudinal axis of the jet needle and thus at the side of the outer circumference of the jet needle, it becomes necessary to employ an annular ring shaped diaphragm. In such case, the diaphragm is fixed between the carburettor body and the cover at the center portion and the outer circumferential portion. With this construction, upon displacing the diaphragm depending upon pressure variation within the regulator chamber, a difficulty is encountered in controlling fine movement for fixing both circumferential edges to cause degradation of dynamic characteristics of the diaphragm. Thus, the second prior art has poor fuel controllability relative to the pressure variation. On the other hand, the foregoing drawback may be improved by arranging the diaphragm at lower side to the tip end of the jet needle to obtain high fuel controllability by improving dynamic characteristics of the diaphragm relative to pressure variation of the regulator chamber. However, in this construction, the overall height of the jet needle in longitudinal direction becomes quite large to make it difficult to provide compact carburettor. Also, since the regulator chamber and the induction passage are distanced significantly, response characteristics of the fuel from the regulator chamber to the induction passage can be degraded. Furthermore, the diaphragm is required to be certainly sealed at the central portion and outer peripheral portion to require double seal to make sealing operation difficult.

In the third prior art, it is possible to cause unstability of the engine revolution speed at low speed operation of the engine. This is because the upstream side of the main fuel jet opens to the regulator chamber storing the fuel therein, and the downstream side of the main fuel jet opens to the Venturi portion of the induction passage opposing to the projecting surface in the gravity direction (vertical direction) of the regulator chamber. In other words, the downstream side of the main fuel jet opens to the Venturi portion in the induction passage opposing the fuel in the gravity direction of the regulator chamber.

Here, consideration is given for the low engine speed condition, the throttle valve maintains the small open area in the induction passage. In a by-pass passage formed in the induction passage corresponding to the end portion of the throttle valve which is held in small open degree condition, a large vacuum pressure acts. By this, the fuel in the regulator chamber is controlled by the low speed fuel jet, fuel for low revolution speed of the engine is supplied into the induction passage from the by-pass passage for driving engine at low speed. On the other hand, since the main fuel jet opens to the Venturi portion, and the air flow passage area is restricted by the throttle valve in the small open degree state at the downstream side of the Venturi portion so that large vacuum is not generated in the Venturi portion. Accordingly, the fuel in the regulator chamber is not drawn into the Venturi portion via the main fuel jet. Namely, in the low engine speed state, the engine is driven at low revolution speed by fuel for low engine speed controlled by the low speed fuel jet. Then, in such low revolution speed state of the engine, the carburettor may vibrate by vibration induced by the engine per se or by vibration of a vehicle, ship or so forth, on which the engine is mounted. When the carburettor is subject vibration, to cause vibration of the diaphragm and the fuel per se to cause waving of the fuel within the regulator chamber. By this waving, the fuel may be intermittently injected into the Venturi portion from the regulator chamber. Namely, the fuel in the regulator chamber is waved by vibration transmitted to the carburettor. Then, due to inertia of the fuel per se, the fuel may pass through the main fuel jet and then flows into the Venturi portion due to gravitational weight of the fuel per se since the downstream side of the main fuel jet opened to the Venturi portion in opposition to the fuel in the direction of gravity of the regulator chamber. Thus, in addition to the optical amount of fuel for low speed state supplied from the by-pass passage, extra amount of fuel may be supplied through the main fuel jet to cause over-rich state of the air/fuel mixture. This results in unstability of the engine revolution speed during low engine speed state.

SUMMARY OF THE INVENTION

The present invention has been worked out in view of the drawbacks in the prior arts set forth above. Therefore, it is an object of the present invention to provide a down-drafting constant vacuum type diaphragm carburettor which is tiltable and holds superior fuel controllability and fuel response characteristics.

Another object of the invention is to provide a down-drafting constant vacuum type diaphragm carburettor which can provide stability for an engine even at low engine speed.

A further object of the invention is to provide a compact down-drafting constant vacuum type diaphragm carburettor.

According to the first aspect of the invention, a down-drafting constant vacuum pressure type diaphragm carburettor comprises:

- a carburettor body formed with an induction passage along a vertical axis;
- a throttle valve controlling an open area of the induction passage;
- a Venturi portion variable of open area;
- a vacuum actuated valve arranged at upstream side of the throttle valve across the induction passage and extending in horizontal direction from one side to the other side, and controlling an open area of a Venturi portion depending upon a vacuum pressure generated in the Venturi portion;
- a jet needle mounted on the vacuum actuated valve and extending in horizontal direction from a bottom of the vacuum actuated valve to the other side along shifting direction of the vacuum actuated valve, the jet needle being inserted into a needle jet opening to the induction passage in opposition to the bottom portion of the vacuum actuated valve; and
- a fuel control system including
  - a diaphragm arranged between a recessed portion of the carburettor body and a cover covering the recessed portion for defining a regulator chamber at the side of the recessed portion and an atmospheric pressure chamber at the side of the cover, the diaphragm being arranged at lower side of a longitudinal axis of the jet needle and substantially in parallel along the longitudinal axis; and
  - a valve seat having a control aperture being opened and closed communicated with a fuel source by a valve operated in response to shifting of the diaphragm, a main jet supplying a main fuel controlled toward at least the needle jet, being arranged within a regulator chamber formed at a position lower than the longitudinal axis of the jet needle.

With the construction set forth above, since the open area in the Venturi portion is controlled by the vacuum actuated valve, atomization characteristics of the fuel can be improved. Also, since diaphragm type fuel control system is employed, it becomes possible to provide the down-drafting type carburettor having good characteristics in tilting orientation.

On the other hand, since the diaphragm is located below the longitudinal axis of the jet needle in the horizontal direction, and horizontally arranged along the longitudinal axis, a disc shaped diaphragm can be employed to improve controllability of the fuel and response characteristics in fuel amount control. Furthermore, with the construction set forth above, the overall height of the carburettor including the fuel supply system can be made smaller to permit the overall carburettor to be constructed in compact. Furthermore, in the down-drafting type carburettor, the main fuel jet and the Venturi portion are located at higher position in the gravitational direction than the regulator chamber, stable engine revolution can be obtained at low engine speed, even when the fuel within the regulator chamber causes waving.

In addition, since the diaphragm is in flat configuration and is clamped between the carburettor body and the cover to facilitate assembling operation and to certainly maintain sealability.

According to the second aspect of the invention, a down-drafting constant vacuum pressure type diaphragm carburettor comprises:

a carburettor body formed with an induction passage along a vertical axis;

a throttle valve controlling an open area of the induction passage;

a Venturi portion variable of open area;

a vacuum actuated valve arranged at upstream side of the throttle valve across the induction passage and extending in horizontal direction from one side to the other side, and controlling an open area of a Venturi portion depending upon a vacuum pressure generated in the Venturi portion;

a jet needle mounted on the vacuum actuated valve and extending in horizontal direction from a bottom of the vacuum actuated valve to the other side along shifting direction of the vacuum actuated valve, the jet needle being inserted into a needle jet opening to the induction passage in opposition to the bottom portion of the vacuum actuated valve;

a bleed tube communicated with the needle jet and defining a fuel passage, in which the jet needle is inserted;

a fuel control system including a diaphragm arranged between a recessed portion of the carburettor body and a cover covering the recessed portion for defining a regulator chamber at the side of the recessed portion and an atmospheric pressure chamber at the side of the cover, the diaphragm being arranged at lower side of a longitudinal axis of the jet needle and substantially in parallel along the longitudinal axis; and a valve seat having a control aperture being opened and closed communicated with a fuel source by a valve operated in response to shifting of the diaphragm, a main jet supplying a main fuel controlled toward at least a fuel passage of the bleed tube;

a main air controlled by a main air jet toward a bleed aperture formed in the bleed tube.

In the construction set forth above, the bleed type having the bleed aperture is arranged at the upstream side of the needle jet. The fuel passing through the bleed tube is supplied via the bleed aperture by the air controlled by the main air jet. Thus, correction of air/fuel ratio, improvement of atomization characteristics and improvement of transitional drivability can be achieved. In addition, with the construction set forth above, freedom in setting of the carburettor can be increased to improve adaptability of the engine.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The present invention will be discussed hereinafter in detail in terms of the preferred embodiments of the invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
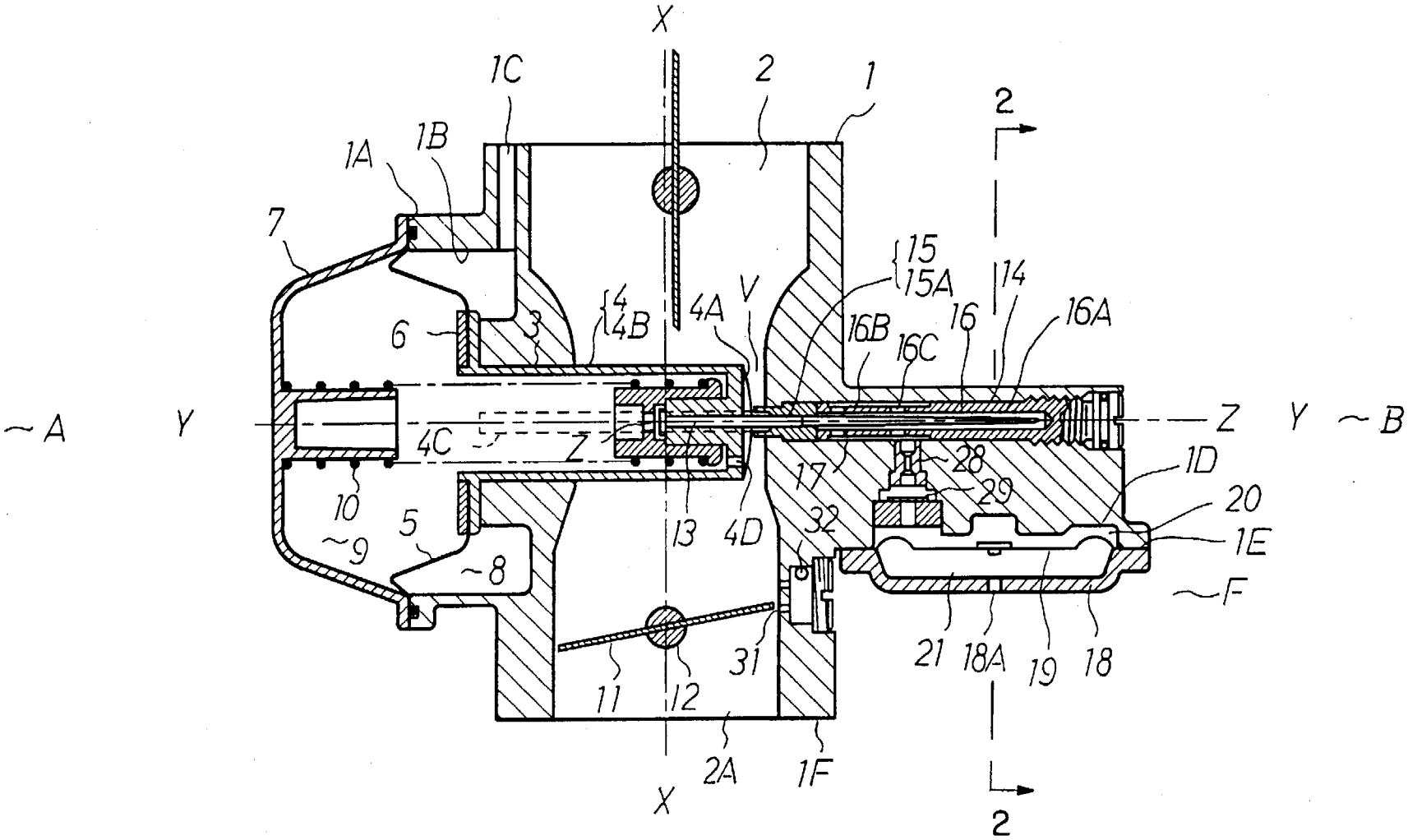
FIG. 1 is a longitudinal section showing the first embodiment of a down-drafting constant vacuum type diaphragm carburettor according to the present invention.
Figure 2:
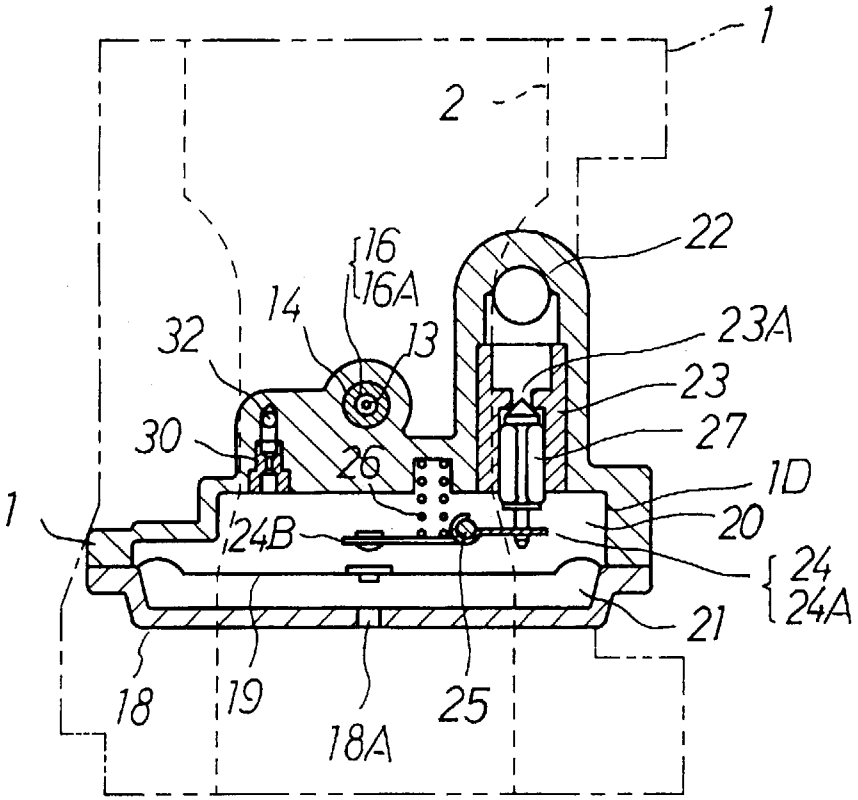
FIG. 2 is a longitudinal section taken along line C—C of FIG. 1.

Referring now to the drawings, particularly to FIGS. 1 and 2, the first embodiment of a down-drafting constant vacuum type diaphragm carburettor according to the present invention will be discussed. FIG. 1 is a longitudinal section showing the first embodiment of a down-drafting constant vacuum type diaphragm carburettor according to the present invention, and FIG. 2 is a longitudinal section taken along line C—C of FIG. 1. In the drawings, the reference numeral 1 denotes a carburettor body defining an induction passage 2 extending therethrough along a vertical direction (from upper side to lower side) along an axis X—X. A vacuum actuated valve guide bore 3 is formed through the carburettor body 1 to extend transversely to the induction passage 2 and to communicate with the intermediate portion of the latter.

In the following disclosure, the directions, e.g. left and right or so forth, represent the direction on the drawings for the purpose of disclosure. It should be appreciated that the directions as identified herein are just for facilitating understanding of the illustrated constriction of the preferred embodiments and should not be specific or essential to the present invention unless otherwise specifically mentioned.

In the shown embodiment, the vacuum actuated valve guide bore 3 extends from the intermediate portion of the induction passage toward left A. The left side outer end of the vacuum actuated valve guide bore 3 opens to an larger diameter cylindrical cavity 1B which has an opening end 1A. As can be seen, in the shown embodiment, the vacuum actuated valve guide bore 3 extends in horizontal direction along an axis Y—Y which extends perpendicularly to the vertical direction along the axis X—X of the induction passage 2.

The reference numeral 4 denotes a vacuum actuated valve movably arranged with in the vacuum actuated valve guide bore 3. A bottom portion 4B of the vacuum actuated valve 4 is cooperated with the mating portion of the inner peripheral wall of the induction passage 2 to form a Venturi portion V. The vacuum actuated valve 4 moves in horizontal direction along the axis Y—Y across the induction passage 2 for variably controlling opening area of the Venturi portion V. The cross-sectional configuration of the vacuum actuated valve 4 in the direction perpendicular to the longitudinal axis can be circular, rectangular, a composite configuration of a center circle and rectangular portions extending from the center circle, or any appropriate configuration. In the shown embodiment, a plate portion 4C is extended outwardly from a central cylindrical portion 4B. At the upper end of the vacuum actuated valve 4, a cap-shaped diaphragm 5 is integrally mounted via a retainer 6. The outer peripheral portion of the diaphragm 5 is clamped between the opening end 1A of the carburettor body 1 and a cap-shaped cover 7 arranged on the opening end 1A. With the construction set forth above, an atmospheric pressure chamber 8 is defined by a right side surface of the diaphragm and the larger diameter cylindrical cavity 1B. On the other hand, a pressure receiving chamber 9 is defined by a left side surface of the diaphragm 5 and the cover 7.

In the atmospheric pressure chamber 8, an atmospheric pressure is introduced into an atmospheric pressure induction passage 1C formed in the carburettor body 1. On the other hand, in the pressure receiving portion 9, a vacuum generated in the Venturi portion V is introduced through a vacuum induction passage 4D formed in the bottom portion 4A of the vacuum actuated valve 4. It should be noted that the reference numeral 10 denotes a vacuum actuated valve spring engaged to the cover 9 at one end and to the vacuum actuated valve 4 at the other end. The vacuum actuated valve 4 is biased to reduce the opening area of the Venturi portion V by spring force of the vacuum actuated valve spring 10.

Air flows through the Venturi portion V to generate a vacuum in the Venturi portion V. The vacuum is introduced into the pressure receiving chamber 9 via the vacuum induction passage 4D of the vacuum actuated valve 4. The position of the vacuum actuated valve 4 is determined at a condition where a balance of a leftward drawing force for the diaphragm 5 in the pressure receiving chamber 9 and a rightward pushing force of the vacuum actuated valve spring 10 is established. Thus, depending upon the vacuum generated in the Venturi portion V, the open area of the Venturi portion V is determined.

The reference numeral 11 denotes a throttle valve for opening and closing a downstream portion 2A of the induction passage 2. The throttle valve 11 is mounted on a throttle valve shaft 12 rotatably supported on the carburettor body 1.

The reference numeral 13 denotes a jet needle integrally mounted on the vacuum actuated valve 4. The jet needle 13 extends in horizontal direction along the axis Y—Y from the bottom portion 4A of the vacuum actuated valve 4 to the other (right) side B. In order word, the longitudinal axis Z—Z of the jet needle 13 extends along the axis Y—Y in the horizontal direction.

The reference numeral 14 denotes a fuel metering member insertion hole formed in the carburettor body 1 and extending from the other (right) side B toward the Venturi portion V. The needle jet 15 and a fuel pipe 16 are inserted within the fuel metering member insertion hole 14.

The needle jet 15 has a metering aperture 15A on the longitudinal axis thereof. On the other hand, the fuel pipe 16 is formed with a fuel passage 16A extending along the longitudinal axis thereof. The fuel pipe 16 is formed with an annular groove 16B on the outer periphery thereof. As can be seen, the annular groove 16B is located in the vicinity of the tip end of the fuel pipe 16 and communicated with the fuel passage 16A via radially extending fuel introduction conduits 16C. Within the fuel metering member insertion hole 14, the fuel pipe 16 is arranged in opposition to the rear or outer end of the needle jet 15.

In the construction set forth above, the tip end of the needle jet is arranged to open within the Venturi portion V. On the other hand, the metering aperture 15A of the needle jet 15 is arranged coaxially with the fuel passage 16A of the fuel pipe 16 and extends along the horizontal axis Y—Y. Also, an annular fuel chamber 17 is defined by the annular groove 16B of the fuel pipe 16 and the inner periphery of the fuel metering member insertion hole 14. The annular fuel chamber 17 is communicated with the fuel passage 16A via the fuel introduction conduit 16C.

Then, as set forth above, tip end portion of the jet needle 13 extending from the bottom portion 4A of the vacuum actuated valve 4 toward the other side B along the horizontal direction Y—Y is inserted into the metering aperture 15A of the needle jet 15 and the fuel passage 16A of the fuel pipe 16. The longitudinal axis Z—Z of the jet needle 13 extends along the horizontal axis Y—Y even within the metering aperture 15A and the fuel passage 16A.

The fuel control system F is constructed as follow. The reference numeral 1D denotes a recessed portion of the carburettor body 1 formed at lower side than the longitudinal axis Z—Z of the jet needle 13 in gravitational direction. A lower opening end portion 1E of the recessed portion 1D is formed in parallel to the longitudinal axis Z—Z. The reference numeral 18 denotes a cover arranged on the lower opening end portion 1E of the recessed portion 1D for closing the latter. The cover 18 is formed with an atmosphere communication hole 18A. The reference numeral 19 denotes a flat diaphragm fixed at the outer periphery/ With the upper surface of the diaphragm 19 and the recessed portion 1D, a regulator chamber 20 is formed. On the other hand, with the lower surface of the diaphragm 19 and the cover 18, an atmospheric pressure chamber 21 is defined.

With the regulator chamber 20, a fuel supply line 22 communicated with a fuel source (not shown) is opened. At an opening end portion of the fuel supply line 22 to the regulator chamber 20, a valve seat 23 having a control aperture 23A is arranged. The reference numeral 24 denotes an arm pivotable supported on a shaft 25. The arm 24 is biased for pivoting in the counterclockwise direction by means of a spring 26. A right end 24A of the arm 24 is engaged to a valve 27 which controls the control aperture 23A arranged within the valve seat 23 to open and close. A left end 24B of the arm is arranged in opposition to the upper surface of the diaphragm 19 (as best shown in FIG. 2). With the construction set forth above, when the diaphragm 19 is shifted upwardly toward the regulator chamber 20. Then, the diaphragm 18 abuts to the left end 24B of the arm 24 for causing clockwise pivotal movement of the latter. Then, the arm 24 opens the control aperture 23A by the valve 27 which is actuated by the right end 24A of the arm 24. Thus, the fuel is introduced into the regulator chamber 20 from the fuel supply line 22 via the valve seat 23.

The reference numeral 28 denotes a main fuel jet. An upstream side of the main fuel jet is communicated with the regulator chamber 20 via a one-way check valve 29. The downstream of the main fuel jet 28 is communicated with the annular fuel chamber 17. It should be noted that throughout the disclosure, the wordings "upstream" and "downstream" represent the position relative to the flow direction. The one-way check valve 29 permits flow of the fuel directed from the regulator chamber 20 to the annular fuel chamber 17 and serves for blocking fuel flow from the annular fuel chamber 17 to the regulator chamber 20 (as best shown in FIG. 1).

The reference numeral 30 denotes a low speed fuel jet. The upstream side of the low speed fuel jet 30 is communicated with the regulator chamber 20 and the downstream side thereof is communicated with a by-pass passage 31 opening to the induction passage 2A corresponding to the end of the throttle valve 11, via a low speed mixture passage 32 (the low speed fuel jet is best shown in FIG. 2).

Next, operation will be discussed.

At small open angle state of the throttle valve 11, the intake air flows from the upper side to the lower side of the induction passage. Then, vacuum pressure in the induction passage 2A in the vicinity of the by-pass passage 31 formed corresponding to the end portion of the throttle valve 11 is increased. On the other hand, in the Venturi portion V, since the downstream side of the induction passage 2A is restricted by small open degree of the throttle valve 11, the vacuum pressure in the Venturi portion V is not increased. By this, increased vacuum pressure is introduced into the regulator chamber 20 from the by-pass passage 31 via the low speed mixture passage 32, the low speed fuel jet 30. Then, the diaphragm 19 shifts toward the regulator chamber 20 (upper side in the drawing) depending upon the vacuum pressure. By shifting of the diaphragm 19, the arm 24 is pivoted in clockwise direction against the spring force of the spring 26 about the shaft 25 to pull down the valve 27 to open the control aperture 23. The fuel corresponding to opening of the control aperture 23 is introduced within the regulator chamber 20 via the fuel supply line 22 and the valve seat 23. Then, the fuel in the regulator chamber 20 is controlled by the low speed fuel jet 30 and supplied into the induction passage 2A from the by-pass passage 31 via the low speed mixture passage 32. Thus, the engine is driven at low revolution speed.

The, in such low revolution speed state of the engine, a fuel stored in the diaphragm 19 and the regulator chamber 20 is subject to vibration of the engine or vehicle, ship or so forth, in which the engine is mounted, to cause waving.

Here, in the present invention, the diaphragm 19 is arranged at the lower side of the longitudinal axis Z—Z of the jet needle 13, by forming the regulator chamber 20 at the position lower side of the longitudinal axis Z—Z of the jet needle 13, the fuel may not flow into the Venturi portion V from the needle jet 15 even when waving is caused in the fuel. When opening position of the needle jet 15 to the venturi portion V is located at the upper side of the regulator chamber 20 in the gravitational direction, the fuel may not flow into the Venturi portion V from the needle jet 15 by the gravitational force even when waving of the fuel is caused in the regulator chamber 20, for example.

As set forth above, low speed driving of the engine is performed by the appropriately controlled low speed fuel supplied from the by-pass passage 31. Therefore, stable low revolution speed of the engine can be obtained.

Next, when the throttle valve 11 is operated into medium open angle state or large open angle state, the intake air flows through the Venturi portion V as increased intake air flow area at the downstream side defined by the throttle valve 11 to increase vacuum pressure in the Venturi portion V. The vacuum pressure in the Venturi portion V is introduced into the pressure receiving chamber 9. Then, the position of the vacuum actuated valve 4 is determined at the condition where the vacuum pressure of the pressure receiving chamber 9 and the spring force of the vacuum actuated valve spring 10 are balanced. Thus, an appropriate open degree of the Venturi portion V corresponding to the vacuum pressure in the Venturi portion is obtained. Thus, an intake air flow rate flowing through the Venturi portion V can be substantially constant.

On the other hand, the increased vacuum pressure in the Venturi portion V is introduced into the regulator chamber 20 via the needle jet 15, the fuel pipe 16, the main fuel jet 28 and the one-way check valve 29 in open condition. In the regulator chamber 20, the diaphragm 19 is shifted upwardly by introducing the increased vacuum pressure. Thus, the valve 27 is operated to further open the control aperture 23A of the valve seat 23. Thus, increase amount of fuel corresponding to the increased vacuum pressure is supplied into the regulator chamber 20.

The fuel in the regulator chamber 20 flows into the main fuel jet 28 via the one-way check valve 29 in open condition. The amount of fuel is then controlled by the main fuel jet 28. The fuel is then drawn into the fuel passage 16A of the fuel pipe 16 via the fuel introduction conduit 16C. The fuel within the fuel passage 16A is further metered by a metering gap corresponding to the open degree of the vacuum actuated valve 4 formed by the needle jet 15 and the jet needle 13. Thus, appropriately controlled fuel is drawn into the Venturi chamber V to provide high driving performance of the engine at medium engine speed range and high engine speed range.

Thus, by controlling the open area of the Venturi portion V by the vacuum actuated valve 4 actuated depending upon vacuum in the Venturi portion V, the air flow rate flowing through the Venturi portion V can be held substantially constant to improve drivability with good atomization of the fuel.

On the other hand, the diaphragm 19 is arranged at lower side of the longitudinal axis Z—Z of the jet needle 13 and in parallel to the longitudinal axis Z—Z. Thus, the regulator chamber 20 can be arranged at lower position than the longitudinal axis Z—Z of the jet needle 13 in gravitational direction and can be formed at relatively close position to the longitudinal axis of the jet needle 13. Furthermore, the diaphragm 19 may be shaped into a flat shape, such as circular, rectangular shape or so forth.

With the construction set forth above, fuel control characteristics can be improved by improving dynamic characteristics of the diaphragm. This is because that the diaphragm 19 is clamped between the lower opening end portion 1E of the carburettor body 1 and the cover 18 only at the outer circumferential portion to maintain the central portion free. Thus, response characteristics of the diaphragm 19 to variation of the vacuum pressure acting in the regulator chamber 20 can be improved to quickly control opening and closing of the control aperture 23A of the valve seat 23 of the valve 27 associating with movement of the diaphragm.

On the other hand, response characteristics of fuel to be supplied to the Venturi portion V can be enhanced. This is because that the diaphragm 19 is arranged at the lower side of the longitudinal axis Z—Z of the jet needle 13 and that the regulator chamber 20 can be formed in the vicinity of the longitudinal axis Z—Z of the jet needle as being arranged substantially parallel to the longitudinal axis Z—Z. Namely, by forming the regulator chamber 20 in the vicinity of the member (i.e. diaphragm) located at lower side of the needle jet 15 in the gravitational direction, a head difference between the opening of the needle jet 15 and the regulator chamber 20 can be made smaller so that the vacuum pressure exerted on the needle jet 15 can instantly act within the regulator chamber 20 to instantly draw the fuel within the regulator chamber 20 toward the Venturi portion V from the needle jet 15.

Also, the size of the diaphragm as the fuel control system can be made compact. This is because that the diaphragm can be arranged in substantially parallel to the longitudinal axis Z—Z of the jet needle 13. Namely, the jet needle 13 has to be maintained in the inserted condition in the needle jet 15 in overall actuation stroke from the minimum open degree position of the vacuum actuated valve to the fully open position thereof, and thus has sufficient length in the longitudinal direction. With the construction set forth above, diaphragm 19 and the regulator chamber 20 can be arranged within a range of the longitudinal axis Z—Z of the jet needle 3. Therefore, in FIG. 1, significant projection of the diaphragm 19 and the regulator chamber 20 toward the other side as right side. Furthermore, the diaphragm 19 and the regulator chamber 20 are arranged between the jet needle 13 and the lower end portion 1F of the carburettor body 1 in the height direction (vertical direction in FIG. 1). Accordingly, since the diaphragm 19 and the regulator chamber 20 are arranged within a projection of the key needle 13 and the carburettor body 1, the down-drafting constant vacuum type vacuum carburettor having the diaphragm type fuel control system can be made compact.

Also, the diaphragm 19 may be flat plate shaped configuration in circular, rectangular configuration or so forth and is clamped only at the outer peripheral portion by the lower opening end portion 1E of the carburettor body 1 and the cover 18. Thus, assembling of the diaphragm 19 can be simplified with good seal as established.

Furthermore, by arranging the induction passage 2 of the carburettor in horizontal direction, the foregoing operation and effect can be achieved as applied for the horizontal type constant vacuum type diaphragm carburettor.

Figure 3:
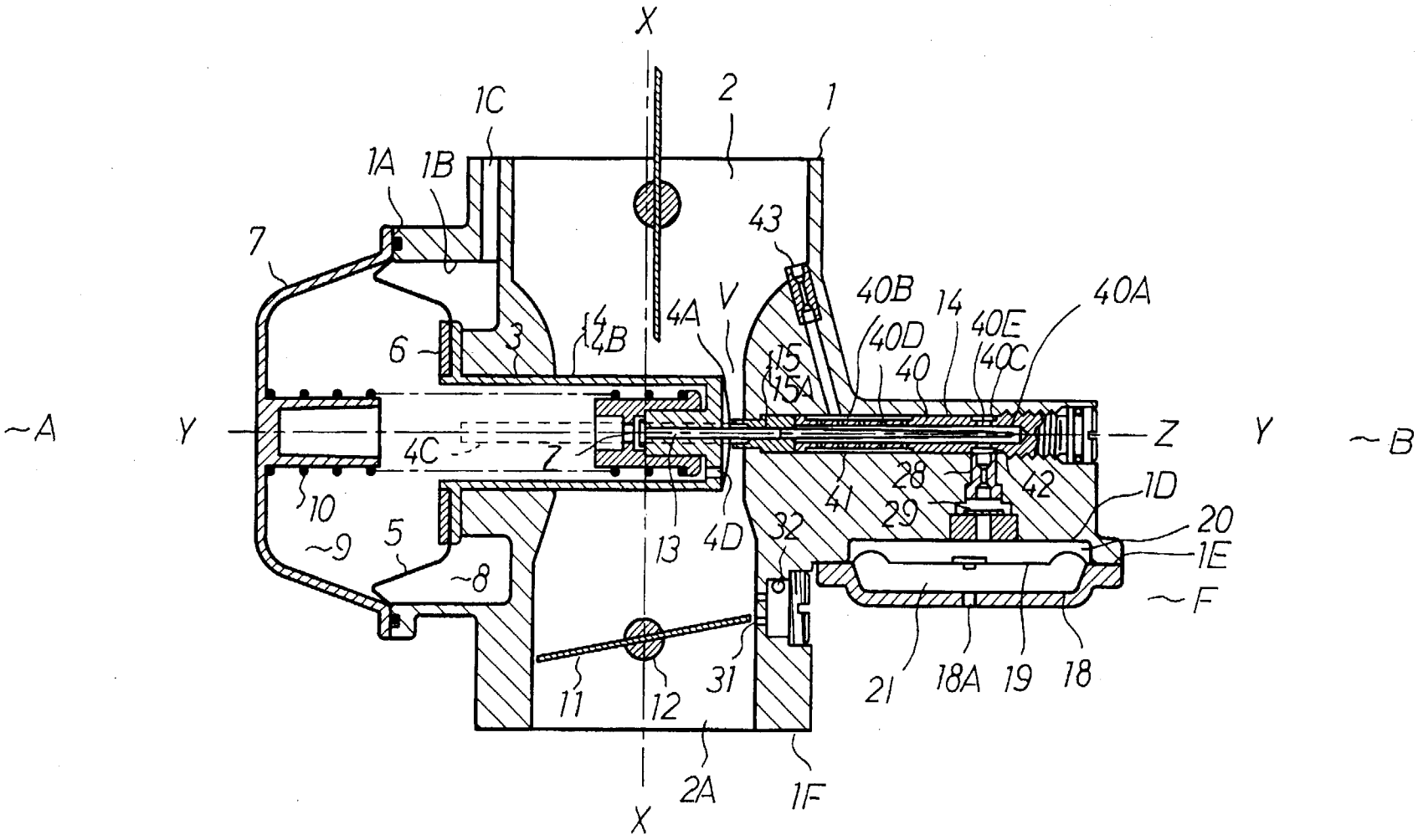
FIG. 3 is a longitudinal section showing the second embodiment of a down-drafting constant vacuum type diaphragm carburettor according to the present invention.

Next, the second embodiment of the down-drafting constant vacuum type diaphragm according to the third embodiment will be discussed. It should be noted that like reference numerals represent the like components disclosed with respect to the second embodiment. In FIG. 3, the reference numeral 40 denotes a bleed tube inserted within the fuel metering member introducing hole 14. The bleed tube 40 has a fuel passage 40A which opens to the left end. On the outer circumference of the tip end, a first annular groove 40B is formed. The bleed tube 40 is also formed with a second annular groove 40C on the outer periphery at the rear end side. In the first annular groove 40B, a plurality of bleed apertures 40D communicated with the fuel passage 40A. In the small diameter portion 40C, a fuel aperture 40D is extended toward the fuel passage 40A.

Within the fuel metering member insertion hole 14, the needle jet 15 is arranged. At the rear end of the needle jet 15, the bleed tube 40 is inserted and fixed therein. With this construction, an annular bleed chamber 41 is defined by the first small diameter portion 40B of the bleed tube 40 and the inner periphery of the fuel metering member insertion hole 14, and an annular fuel chamber 42 is defined by the second annular portion and the inner periphery of the fuel metering member insertion apertures. Then, a main air controlled by a main air jet 43 is introduced into the bleed chamber 41. On the other hand, to the fuel chamber 42, a main fuel controlled by the main fuel jet 28 is introduced.

By the second embodiment, among various driving condition of the engine, in high speed operation, when the vacuum pressure is generated in the Venturi portion V, the vacuum pressure reaches the fuel passage 40A of the bleed tube via the needle jet 15. By this, within the fuel passage 40A, the main fuel controlled by the main fuel jet 28 us introduced via the fuel chamber 42 and the fuel aperture 40E. On the other hand, the main air controlled by the main air jet 43 is introduced via the bleed chamber 41 and the bleed aperture 40D. Accordingly, within the fuel passage 40A of the bleed tube 40, the main fuel and main air are mixed to form atomized mixture. This mixture is drawn to the Venturi portion V via an annular gap formed with the jet needle 13 and the needle jet 15. Thus, in the fuel passage 40A of the bleed tube 40, by forming the atomized mixture, the atomized mixture is effectively supplied to the engine to attain good combustion condition in the engine. Also, by forming the atomized mixture, response characteristics relative to variation of vacuum pressure to achieve improvement in transition characteristics. Furthermore, correction of air/fuel ratio can be facilitated by forming atomized mixture, freedom in setting of the carburettor can be increased to improve adaptivity of the engine.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A down-drafting constant vacuum pressure type diaphragm carburettor comprising:

a carburettor body formed with an induction passage along a vertical axis;

a throttle valve controlling an open area of said induction passage;

a Venturi portion variable of open area;

a vacuum actuated valve arranged at upstream side of said throttle valve across said induction passage and extending in horizontal direction from one side to the other side, and controlling an open area of a Venturi portion depending upon a vacuum pressure generated in said Venturi portion;

a jet needle mounted on said vacuum actuated valve and extending in horizontal direction from a bottom of said vacuum actuated valve to the other side along shifting direction of said vacuum actuated valve, said jet needle being inserted into a needle jet opening to said induction passage in opposition to said bottom portion of said vacuum actuated valve; and a fuel control system including a diaphragm arranged between a recessed portion of said carburettor body and a cover covering said recessed portion for defining a regulator chamber at the side of said recessed portion and an atmospheric pressure chamber at the side of said cover, said diaphragm being arranged at lower side of a longitudinal axis of said jet needle and substantially in parallel along said longitudinal axis; and a valve seat having a control aperture being opened and closed communicated with a fuel source by a valve operated in response to shifting of said diaphragm, a main jet supplying a main fuel controlled toward at least said needle jet, being arranged within a regulator chamber formed at a position lower than said longitudinal axis of said jet needle.

2. A down-drafting constant vacuum pressure type diaphragm carburettor comprising:

a carburettor body formed with an induction passage along a vertical axis;

a throttle valve controlling an open area of said induction passage;

a Venturi portion variable of open area;

a vacuum actuated valve arranged at upstream side of said throttle valve across said induction passage and extending in horizontal direction from one side to the other side, and controlling an open area of a Venturi portion depending upon a vacuum pressure generated in said Venturi portion;

a jet needle mounted on said vacuum actuated valve and extending in horizontal direction from a bottom of said vacuum actuated valve to the other side along shifting direction of said vacuum actuated valve, said jet needle being inserted into a needle jet opening to said induction passage in opposition to said bottom portion of said vacuum actuated valve;

a bleed tube communicated with said needle jet and defining a fuel passage, in which said jet needle is inserted;

a fuel control system including a diaphragm arranged between a recessed portion of said carburettor body and a cover covering said recessed portion for defining a regulator chamber at the side of said recessed portion and an atmospheric pressure chamber at the side of said cover, said diaphragm being arranged at lower side of a longitudinal axis of said jet needle and substantially in parallel along said longitudinal axis; and a valve seat having a control aperture being opened and closed communicated with a fuel source by a valve operated in response to shifting of said diaphragm, a main jet supplying a main fuel controlled toward at least a fuel passage of said bleed tube;

a main air controlled by a main air jet toward a bleed aperture formed in said bleed tube.

* * * * *